US008344301B2

(12) United States Patent
Singh et al.

(10) Patent No.: US 8,344,301 B2
(45) Date of Patent: Jan. 1, 2013

(54) RAPID AND HOMOGENOUS HEAT TREATMENT OF LARGE METALLIC SAMPLE USING HIGH POWER MICROWAVES

(75) Inventors: Kulvir Singh, Hyderabad (IN); Nirmal Sharma, Hyderabad (IN); Jaipal Reddy Gurram, Hyderabad (IN); Swaminathan Gopalan, Hyderabad (IN)

(73) Assignee: Bharat Heavy Electricals Limited, Kolkata (IN)

( * ) Notice: Subject to any disclaimer, the term of this patent is extended or adjusted under 35 U.S.C. 154(b) by 585 days.

(21) Appl. No.: 11/887,175

(22) PCT Filed: Feb. 23, 2006

(86) PCT No.: PCT/IN2006/000062

§ 371 (c)(1),
(2), (4) Date: Feb. 9, 2010

(87) PCT Pub. No.: WO2006/103697

PCT Pub. Date: Oct. 5, 2006

(65) Prior Publication Data

US 2010/0163554 A1 Jul. 1, 2010

(30) Foreign Application Priority Data

Mar. 31, 2005 (IN) ..... 258/KOL/2005

(51) Int. Cl.
*H05B 6/70* (2006.01)

(52) U.S. Cl. ..... 219/690; 219/678; 219/679

(58) Field of Classification Search ..... 219/756, 219/757, 759, 695, 696, 697, 690, 745, 746, 219/762, 711, 710, 714, 678
See application file for complete search history.

(56) References Cited

U.S. PATENT DOCUMENTS

| | | | | |
|---|---|---|---|---|
| 4,307,277 | A | 12/1981 | Maeda et al. | |
| 4,963,709 | A | 10/1990 | Kimrey, Jr. | |
| 5,420,401 | A * | 5/1995 | Jacquault et al. | 219/756 |
| 5,753,572 | A * | 5/1998 | Langenohl et al. | 501/89 |
| 6,159,269 | A * | 12/2000 | Drouet et al. | 75/672 |
| 6,197,243 | B1 * | 3/2001 | Tiegs et al. | 264/432 |
| 6,891,140 | B2 * | 5/2005 | Sato et al. | 219/700 |
| 7,161,126 | B2 | 1/2007 | Ripley | |
| 2005/0178098 | A1 * | 8/2005 | Ono et al. | 55/523 |

FOREIGN PATENT DOCUMENTS

| | | | |
|---|---|---|---|
| EP | 35944 | A * | 9/1981 |
| JP | 2002130960 | | 5/2002 |
| JP | 2003277157 | | 10/2003 |
| WO | 98/23369 | | 4/1998 |

OTHER PUBLICATIONS

"High alumina castables reinforced with SiC", Advances in Applied Ceramics, vol. 104, No. 6, Dec. 2005 , pp. 312-317(6)).*
http://www.sciencedaily.com/releases/1999/06/990622055733.htm, "Metal Parts Made in the Microwave Oven", ScienceDaily, Jun. 22, 1999, University Park, PA.

* cited by examiner

*Primary Examiner* — Henry Yuen
*Assistant Examiner* — Jianying Atkisson
(74) *Attorney, Agent, or Firm* — The Webb Law Firm

(57) ABSTRACT

A system for heat-treatment of large metallic samples including a microwave heating apparatus with a wave guide, means for monitoring and measuring temperature, holding means for holding the metallic sample. The holding means comprises a casket configuration made of low density alumina fiber board and wrapped with low density alumina fiber material to define a cavity and provided with susceptors along the inner walls of the cavity.

4 Claims, 4 Drawing Sheets

RAPID AND HOMOGENOUS HEAT TREATMENT OF LARGE METALLIC SAMPLE USING HIGH POWER MICROWAVES

BACKGROUND OF THE INVENTION

This invention relates to a method of heat-treatment of metallic samples, using microwaves.

This invention further relates to a method of rapid and homogeneous heat treatment of large metallic samples using microwaves.

DESCRIPTION OF RELATED ART

Heating, one of the most critical stages of heat-treatment of metals must be precisely controlled to achieve the desired properties and to avoid variation in properties that could lead to failures in service.

Microwave heating employs microwaves to heat the bulk metal components. It is observed to be very fast and efficient process as compared to the conventional process of heating the metal pieces. Microwave heating can be successfully used on a range of material including metals like various kinds of steels and alloys of Cu, Al etc. Advantages of the technique include significantly faster heating rates, uniform mechanical properties, energy saving, instantaneous and good control over the temperature and process. However, most samples are difficult to heat in microwaves, mainly due to build up of surface charge on metals. Microwave systems for commercial use operate at 2450 MHz, which has a wavelength of 4.8" in air. Materials differ in their reaction to microwave field. Polar molecules in receptive materials respond to these fields by oscillating in rotary motion. The energy generated by this motion causes these substances to get heated up. The dielectric loss and loss tangent dictates the effective absorption of microwaves and hence their heating characteristics. Metal powder compacts are dictated by their permissivity. However, bulk metals reflect microwaves and the mechanism of surface heating is mainly dictated by the eddy currents. In a conductive surface this is associated with charge build up and subsequent voltage build up resulting in arcing with cavity walls.

Microwave energy has been in use for over 50 years in a variety of applications, such as communications, food processing, rubber vulcanization, textile and wood products, and drying of ceramic powders. The application of microwaves in the sintering of ceramics is relatively new. A laboratory publication of the Penn State University USA, has first reported that power metal compacts could be sintered and has gone on to demonstrate sintering of different metallic systems and have also built inert gas sintering systems. Based on this development Dennis tools has adapted for commercial production of tungsten carbide tools insert. Some inert gas sintering systems for sintering metallic powder have been developed to facilitate sintering of powder metal compacts. However, no heat treatment of metals using microwave is known in the art. Although many potential advantages of using microwaves to process ceramics have been long recognized, it is only now that this field has finally shown to be at the take off stage, especially for the commercialization of some specialty ceramics, including composites. However, heat-treatment of metals is not known in the art is not really understood. Therefore, the need exists to provide a system to specifically cater to the needs of heating the metal components by providing high power microwave-absorbing boundary around the object so that an inner wall temperature matches with the component surface temperature. In addition the boundary should not allow arcing between the component and the cavity walls.

SUMMARY OF THE INVENTION

It is therefore an object of this invention to propose a method of heat treatment of large metallic samples using microwave whereby uniform and faster heat treatment can be provided.

It is a further object of this invention to propose a method of heat treatment of metallic samples using microwave, which is simple, easy to operate and is cost-effective, Another object of this invention is to propose a method of heat treatment of metallic samples using microwave which establishes equilibrium temperature quickly and minimizes heat loss from the surface.

These and other objects of the invention will be apparent from the ensuing description.

An embodiment of the invention is directed to a system for heat-treatment of large metallic samples, comprising a microwave heating apparatus with wave guide, means for monitoring and measuring temperature, holding means for holding the metallic sample, wherein said holding means comprises a casket configuration made of low density alumina fibre board and wrapped with low density alumina fibre material to define a cavity and provided with susceptors along with inner walls of the cavity.

According to this invention is further provided a system for sintering of ceramic bodies, using a special casket arrangement.

In accordance with this invention the system for sintering of metallic bodies comprises microwave heating apparatus consisting of a MW generator with wave guide, temperature insulation arrangement for locating the sample, arrangements for temperature monitoring and measuring and a cavity housing therein a special casket arrangement.

Microwave heating of materials relies on absorbtivity of the sample, which is actually the heating element and also on the absorbtivity of the susceptor, which surrounds the sample. Without appropriate arrangement it is difficult to heat the sample and control the process, especially in lower temperature regions where the material does not absorb microwaves efficiently.

The objects of the invention are achieved by the special casket arrangement for the heat treatment of metals. The casket arrangement is made of low density alumina fiber board and wrapped with low-density fibre material. SiC susceptors are used surrounding the sample to partially absorb the microwaves and get heated to provide an isothermal boundary. This helps to precisely control the temperature during soaking. For example, temperature fluctuation within 1° C. could be very easily achieved in 6 kW systems during soaking period of heat treatment cycle.

BRIEF DESCRIPTION OF THE DRAWINGS

The invention will now be explained in greater details with the help of the accompanying drawing where.

DETAILED DESCRIPTION OF THE PRESENT INVENTION

Figure 1:
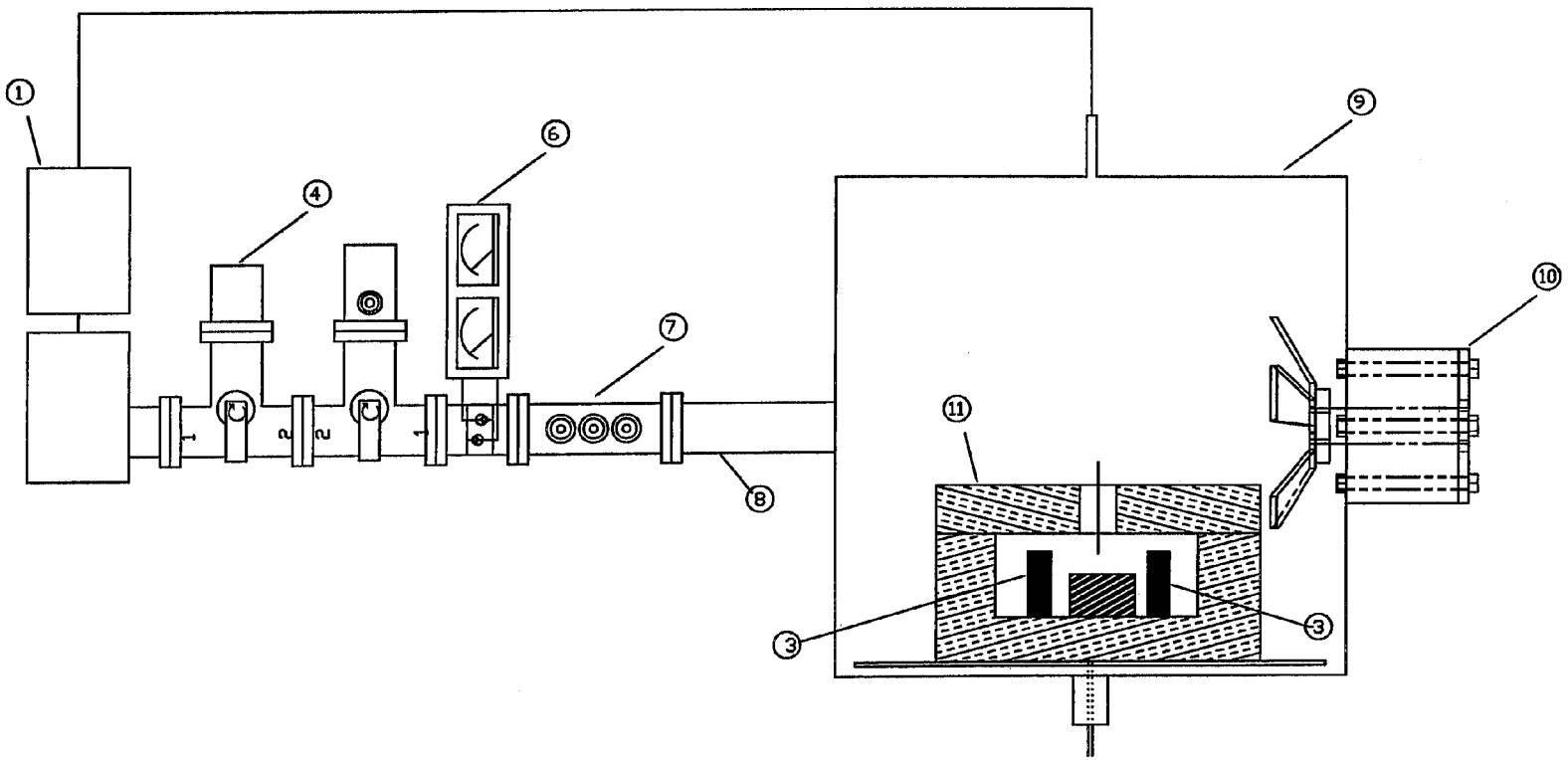
FIG. 1: Typical 6 kw microwave heating system.

FIG. 1 shows a 6 KW microwave heating system consisting of the microwave furnace and the controller.

Figure 2:
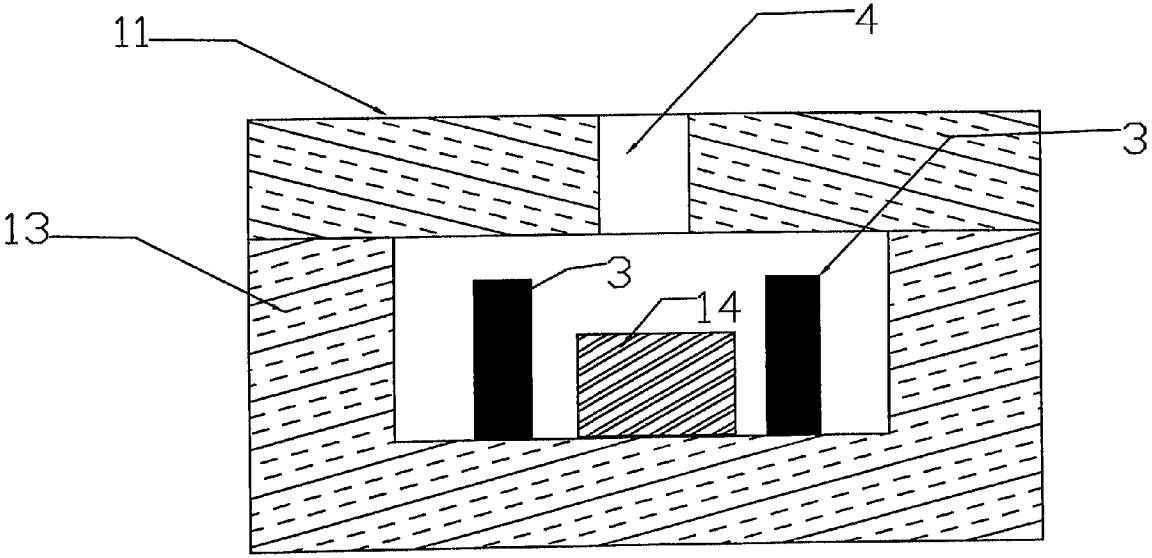
FIG. 2: Casket used for performing heat treatment in 6 kW systems

FIG. 2 shows the casket used for performing heat treatment in 6 kW microwave furnace. It consists of Alumina block wrapped in a low density fibre material.

Figure 3:
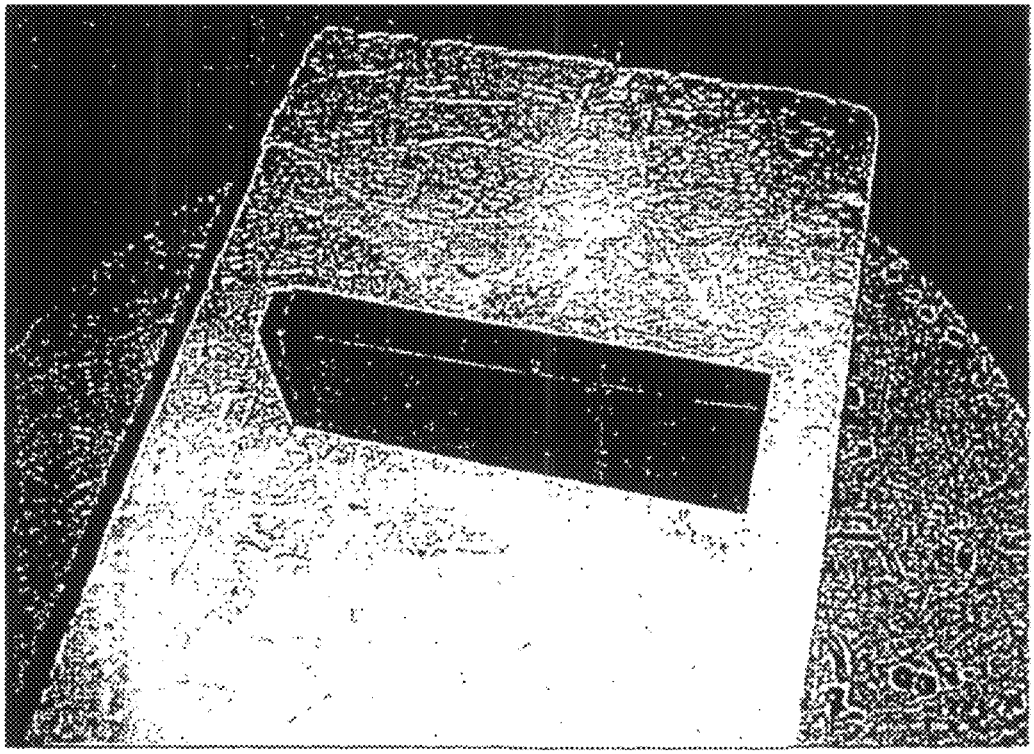
FIG. 3: Typical microwave heat-treated large metallic sample

FIG. 3 shows a 150×30×15 mm sample which is heat treated in the microwave furnace and then cooled in the air. Five to Six such samples can be put together at a time in the furnace for performing uniform heat treatment.

Experiments have been carried out on the P91 material and highly uniform properties have been achieved by heating at a controlled rate (FIG. 4) in the microwave furnace.

Typical arrangement for a 6 kW system employed for heat treatment using high power microwaves is shown in FIG. 1 and the casket arrangement of the invention is shown in FIG. 2. The system comprises at least one magnetorn means for power supply and control (1), dummy loads (4), forward and reverse power monitors (6), tuner (7), a plurality of susceptors (3), a wave guide (8), an applicator (9), and a stirrer (10), a dummy load with adjustable power reflector (6) is disposed between the susceptors (3). A casket (11) is placed in the chamber.

Microwave heating of materials relies on absorbtivity of the sample (14), which is actually the heating element and also on the absorbtivity of the susceptor (3), which surrounds the sample (14). Without appropriate arrangement it is very difficult to heat the sample (14) in lower regions where the material does not absorb Microwaves efficiently. The sample holder arrangement is important. The casket arrangement for sample holder is made of low density alumina castable grade 58A and is mixed with SiC medium size grits in the ratio 2:1. The wet mix is cast in to casket using simple fixtures made of PVC pipes. Because of the coarse bubbles present in alumina castbales no shrinkage is associated with heating even to 1750° C. After 24 hrs the cast sample holders become strong and are ready for usage. The casket arrangement is complete after wrapping it with 1450° C. grade low-density fiber material to a thickness of 2". For such purpose, low-density alumina fibre board (13) is used. A view port (12) for temperature measurement is provided in the casket [FIG. 2].

Figure 4:
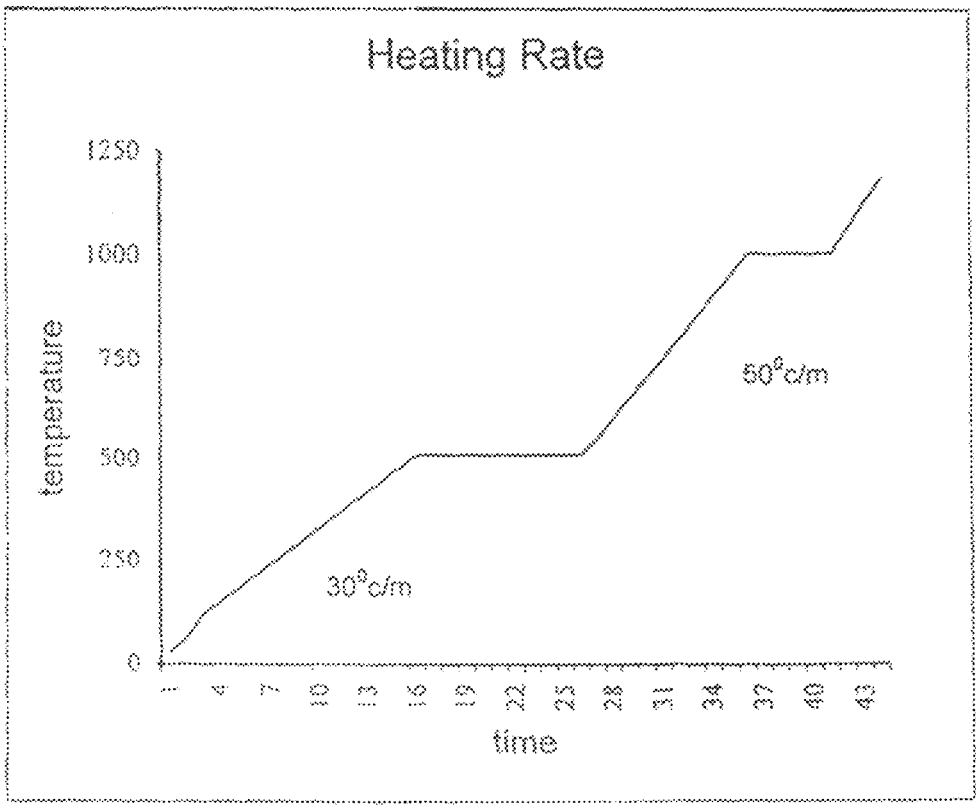
FIG. 4: Typical heating rate profile for heating large metallic sample uniformly and efficiently.

FIG. 4 shows that the rate of heating in the microwave should be optimum as explained in the figure. Microwave heating is a very fast process. Therefore, if heated continuously at a very fast rate to attain desired temperature, the sample would not be heated uniformly and there is likelihood of a temperature gradient over the sample. In contrast with the conventional heat treatment of P91 steel, where it takes almost 3-4 hours to attain the uniform soulutionising (austenitisation) temperature, microwave heating takes only 30-40 minutes.

Figure 5:
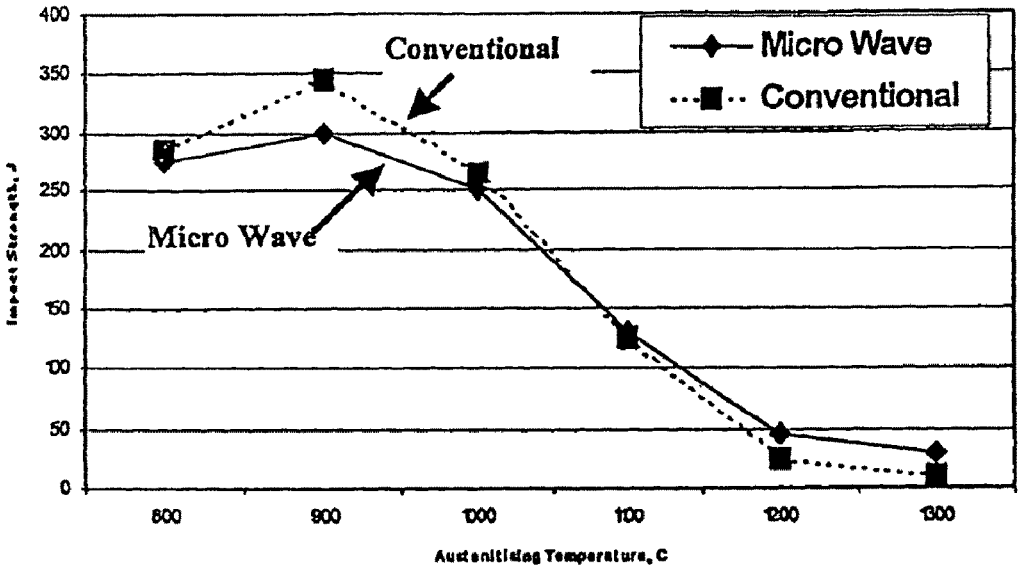
FIG. 5: Typical plot of the impact Strength Vs Austenitising Temperature of the sample heat-treated by MW as well as by convectional electrical resistance heating.

FIG. 5 shows a plot of the impact Strength Vs Austenitising Temperature of the sample heat-treated by MW as well by convectional electrical resistance heating. The impact properties are found decreasing with increasing austenitising temperature or grain size when austenitised above 900° C.

Figure 6:
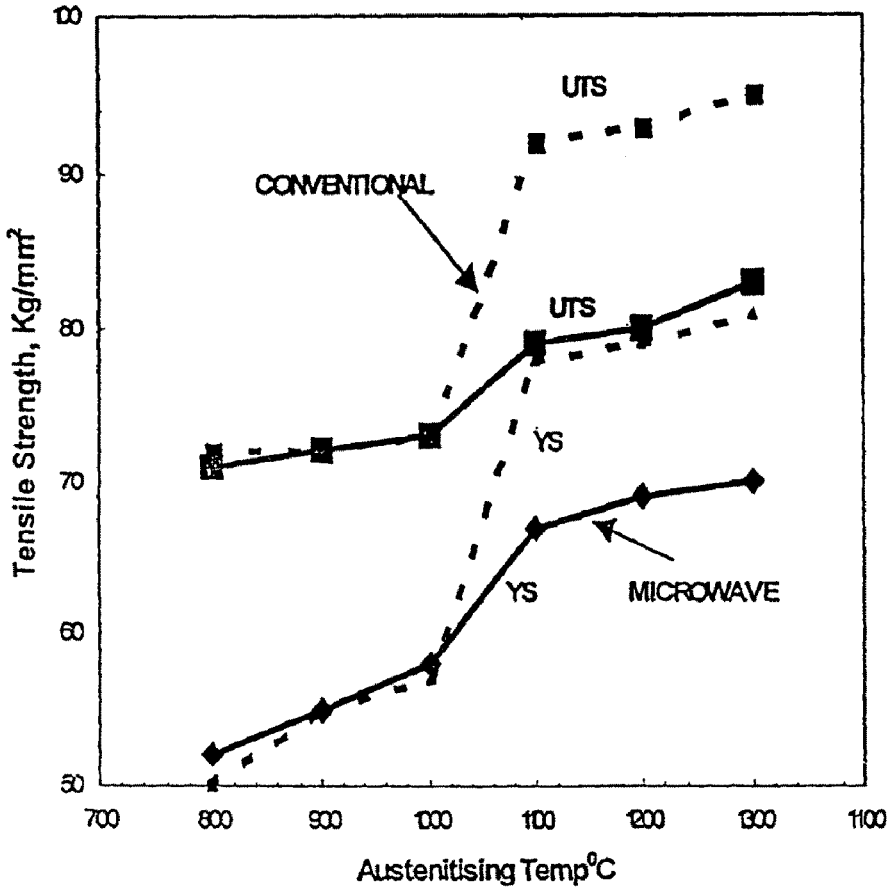
FIG. 6: Typical plot of the Tensile Strength Vs Austenitising Temperature of the sample heat-treated by MW as well as convectional electrical resistance heating.

FIG. 6 shows a plot of the Tensile Strength Vs Austenitising Temperature of the sample heat-treated by MW as well as by convectional electrical resistance heating. The tensile properties are found increasing with increasing austenitising temperature or grain size when austenitised above 900° C., whereas the impact properties exhibited an opposite trend and decreased with increasing austenitising temperature or grain size (FIG. 5).

in order to achieve the forgoing and other objects, and in accordance with the purpose of present invention, embodied and broadly described herein is a scheme to carry out heat treatment of metallic samples using microwave furnace.

The heat treatment of P91 steel was carried out by solutionising P91 steel by holding for 1 hour at 800, 900, 1000, 1100, 1200, 1300° C. and subsequently tempering the samples at 760° C. for 2 hours to represent or simulate various microstructural conditions in heat affected zone (HAZ) encountered during welding viz. over tempered, intercriticalm, fine and coarse grained.

Similar exercise was also carried out in a conventional electrical resistance heating furnace. The results of both the processes are given in FIGS. 5 & 6 and are exactly matching proving the efficacy of microwave heating.

Therefore, by using the system according to the invention the heat treatment of P91 steel by microwave heating is feasible in a much shorter time due to rapid and homogenous heating.

The efficacy of the microwave heat treatment is proved by the excellent matching of the results of impact and tensile strength tests and the microstructure and grain size obtained by conventional and microwave heating are same.

Further, the method provides homogeneous and uniform heat treatment of large pieces of metal. The absorbing boundary transmits part of the microwave energy and the method provides a boundary that ensures negligible heat loss from surface of the object heated by microwave due to isothermal conditions created so that uniform heating object is achieved. It also allows flexibility to save energy and time and to gain mechanical properties comparable to or even better than conventional processes.

We claim:

1. A system for heat-treatment of large metallic samples, comprising:

a microwave heating apparatus with a wave guide;

means for monitoring and measuring temperature;

holding means for holding the metallic samples, wherein said holding means comprises a casket configuration made of alumina castable grade 58A mixed with silicon carbide grits in a ratio of 2:1 such that the silicon carbide grits are embedded in the alumina castable and wrapped with alumina fiber material to define a cavity and provided with susceptors along inner walls of the cavity, the susceptors constructed from silicon carbide.

2. The system as claimed in claim 1, wherein said microwave heating apparatus is a microwave generator and a controller.

3. The system as claimed in claim 1, wherein said holding means houses the samples to be subjected to heat treatment in the cavity.

4. The system as claimed in claim 1, wherein the alumina fiber material is 1450° C. grade alumina fiber material.

* * * * *